United States Patent [19]

Estlund

[11] 4,054,006

[45] Oct. 18, 1977

[54] PUPPET OPERATED BY BOTH HANDS

[75] Inventor: John P. Estlund, Port Huron, Mich.

[73] Assignee: Marjac Inc., Port Huron, Mich.

[21] Appl. No.: 670,041

[22] Filed: Mar. 24, 1976

[51] Int. Cl.[2] ..... A63H 3/14

[52] U.S. Cl. ..... 46/154; 46/126

[58] Field of Search ..... 46/154, 126, 161

[56] References Cited

U.S. PATENT DOCUMENTS

| | | | |
|---|---|---|---|
| 1,350,711 | 8/1920 | Dondo | 46/161 |
| 1,501,912 | 7/1924 | Meehan | 46/126 |
| 2,762,163 | 9/1956 | Stein | 46/154 |
| 2,795,896 | 6/1957 | Snyder | 46/126 X |

FOREIGN PATENT DOCUMENTS

| | | | |
|---|---|---|---|
| 67,588 | 10/1950 | Netherlands | 46/126 |

*Primary Examiner*—F. Barry Shay

*Attorney, Agent, or Firm*—Harness, Dickey & Pierce

[57] ABSTRACT

The puppet has a head from which a collar-like element extends downwardly below the mouth area for the receipt of the operator's arm. The mouth of the head is manipulated by one hand of the operator to simulate talking, biting, turning and the like. The head has hard, bulging eyes and a soft nose which are secured above the mouth area. The head and collar element are made of fabric material which may be of any type, the one herein illustrated is a woven cloth having long strands of fibers simulating hair over the outside thereof. Below the mouth area a pair of flexible extending arms are attached to opposite sides of the collar at the base of the head. Each arm is made of a cloth material which is doubled over and stitched along the bottom edge leaving an opening in which a rod is slideably secured. The rods have rubber tips on the inner and outer ends which require a substantial force for removal. The rods and arms are operated by one hand while the mouth and head of the puppet are actuated by the other hand of the operator.

4 Claims, 1 Drawing Figure

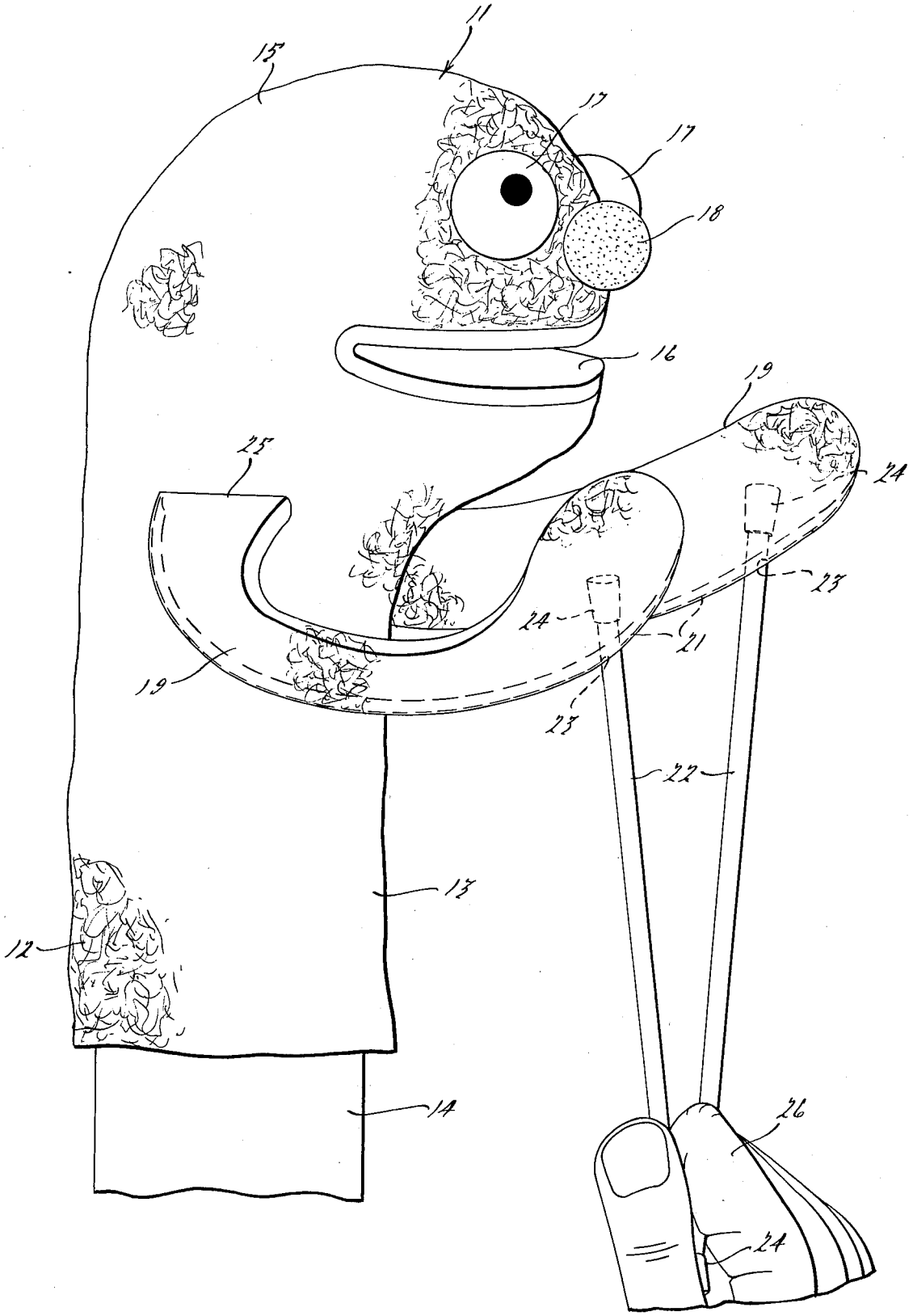
11
15
17
17
18
16
19
25
24
23
24
21
19
23
22
13
12
14
26
24

PUPPET OPERATED BY BOTH HANDS

BACKGROUND OF THE INVENTION

A search of the art produced U.S. Pat. Nos. 1,648,411; 2,551,195 and 2,709,870 which discloses a puppet having arms which are operated by the same hand that moves the head. This is entirely different from the present puppet which requires both hands to be employed to move the mouth and the arms to produce the puppet operation.

BRIEF DESCRIPTION OF THE DRAWING

The single FIGURE of the drawing discloses a puppet with one arm of the operator extending therein to have the hand thereof operate the puppet's mouth with the puppet's flexible arms having rods extending therefrom actuated by the other hand of the operator.

DESCRIPTION OF THE PREFERRED EMBODIMENT

As illustrated in the FIGURE, a puppet 11 is made from a woven material which may have simulated hair or like substance 12 covering the outside thereof. The material is stitched to form a downwardly presenting tubular element 13 in the open end of which the arm 14 of an operator extends to have the hand within the head 15 operate the mouth 16 in the usual manner. The mouth of the head is preferably made of a different hairless material with a pair of bulging eyes 17 of hard plastic and a soft nose 18 secured to the head above the mouth. The eyes are stitched or otherwise secured to the head while the nose is attached to the head by an adhesive at a point below and between the eyes.

A pair of tubular arms 19 has the material thereof folded and secured by stitching 21 with the material disposed inside-out. The rods 22 have a rubber tip 24 secured over each end, one of which is disposed within the reversed material as it is stitched to provide a hole 23 in which the rod is slidable. The rods 22 are preferably made of a clear plastic, such as butyrene, or the like, to the ends of which the hollow rubber tips 24 adheres. Such adherence requires at least 75 pounds of force to have it removed with the butyrene rod bendable but not shatterable. This amount of force is excessively abnormal in the sense of being beyond the force expected to be exerted by a user. The arms 19 are stitched to the opposite sides of the tubular portion 13, at 25, just below the head to be entirely flexible. This permits the other hand 26 of the opertor to grasp the projecting ends of the rods 22 and manipulate the arms to rub the head 15 or tubular portion 13 of the puppet to produce a simulating scratching and petting motion. This permits the mouth 16 of the head which is actuated by the other hand of the operator to snap at the arms and to grasp an arm within the mouth. The use of both hands to manipulate the puppet is new with applicant and adds considerably to the amusement of the child who can spend considerable time having the puppet talk, snap at the arms, move the head and the like.

What is claimed

1. A puppet having a head with a mouth and a downwardly extending portion for receiving a hand and arm, respectively, of an operator, said mouth being actuated by said hand extending into the head, at least one flexible arm means secured to said downwardly extending portion, said arm means being formed of flexible material having rod means secured thereto and extending downwardly near the free end thereof to be manipulated by the other hand of the operator to move the arm means adjacent to said head, and said rod means comprising a rod having an elastomeric cap forced over one end with the cap disposed and secured in an opening provided in the arm means permitting the rod to be freely movable with the arm, said rod and cap being constructed of materials whereby the rod is only removable from the cap upon an excessively abnormal amount of force being applied thereto.

2. The puppet of claim 1 wherein the rod means is a hollow tube.

3. A puppet as recited in claim 2, wherein the tube is made from a plastic material which bends but does not shatter to provide further safety.

4. A puppet as recited in claim 1, wherein the mouth is made from a different material from that of the head and there are two said arm means and rods, with the rods on the ends of the movable arms means manipulated with one hand of the operator as the mouth is actuated by the other hand so that the mouth and arm means may be operated independently.

* * * * *